US005251605A

United States Patent [19]

Swailes

[11] Patent Number: 5,251,605

[45] Date of Patent: Oct. 12, 1993

[54] AIR-FUEL CONTROL HAVING TWO STAGES OF OPERATION

[75] Inventor: Craig R. Swailes, Taylor, Mich.

[73] Assignee: Ford Motor Company, Dearborn, Mich.

[21] Appl. No.: 989,315

[22] Filed: Dec. 11, 1992

[51] Int. Cl.[5] ..... F02M 51/00

[52] U.S. Cl. ..... 123/695; 60/285

[58] Field of Search ..... 123/695; 60/276, 285; 364/431.05, 431.06

[56] References Cited

U.S. PATENT DOCUMENTS

| | | | |
|---|---|---|---|
| 4,494,374 | 1/1985 | Kitahara et al. | 123/695 |
| 4,502,444 | 3/1985 | Rubbo et al. | 123/695 |
| 4,594,984 | 1/1986 | Raff et al. | 123/695 |
| 4,601,273 | 7/1986 | Kitahara et al. | 123/695 |
| 4,825,837 | 5/1989 | Nakagawa | 123/695 |
| 4,953,351 | 9/1990 | Motz et al. | 60/285 |
| 4,993,393 | 2/1991 | Hosoda et al. | 123/695 |

*Primary Examiner*—Raymond A. Nelli

*Attorney, Agent, or Firm*—Peter Abolins; Roger L. May

[57] ABSTRACT

An air-fuel control that has two stages of operation. The control includes an EGO sensor interconnected to the exhaust system of an engine and a control assembly. In a first stage of operation, the engine is allowed to operate in an open loop condition. Periodically, however, the control momentarily moves to a second stage of operation. When in the second state, the control assembly ramps up the air-fuel ratio of the air-fuel mixture supplied to the engine until the EGO sensor changes state. The amount that the air-fuel ratio changed during this process is then compared with a nominal value to compute a correction factor. The correction factor is then used during the next open loop interval to increase or decrease the signal applied to the air-fuel distribution control and achieve a more optimum air-fuel mixture.

12 Claims, 3 Drawing Sheets 22
24
10
12
18
26
30
28
20
32
14
48
38
40
16
CONTROL
ASSEMBLY
48

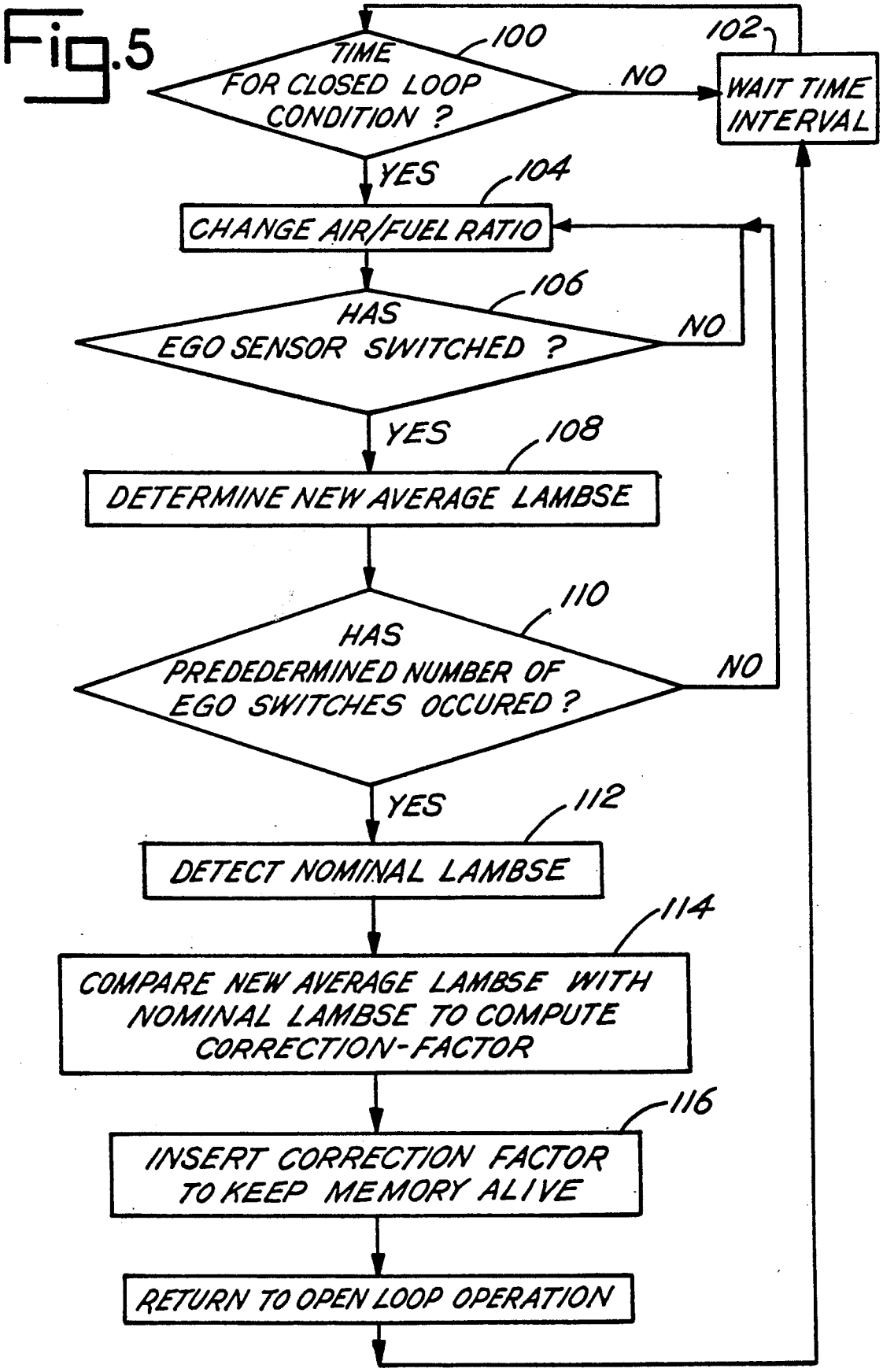
Fig.5
TIME FOR CLOSED LOOP CONDITION ?
100
NO
102
WAIT TIME INTERVAL
YES
104
CHANGE AIR/FUEL RATIO
HAS EGO SENSOR SWITCHED ?
106
NO
YES
108
DETERMINE NEW AVERAGE LAMBSE
HAS PREDEDERMINED NUMBER OF EGO SWITCHES OCCURED ?
110
NO
YES
112
DETECT NOMINAL LAMBSE
114
COMPARE NEW AVERAGE LAMBSE WITH NOMINAL LAMBSE TO COMPUTE CORRECTION-FACTOR
116
INSERT CORRECTION FACTOR TO KEEP MEMORY ALIVE
RETURN TO OPEN LOOP OPERATION

AIR-FUEL CONTROL HAVING TWO STAGES OF OPERATION

BACKGROUND OF THE INVENTION

The present invention relates generally to air-fuel controls for engines and, more particularly, to an air-fuel control for open loop operation of an internal combustion engine. The control has two stages of operation: the open loop (first stage) operation is based on calibrated adjustments derived from momentary closed loop (second stage) operation.

Most internal combustion engines have an air-fuel distribution control that regulates the air-fuel mixture provided to the engine during operation. The engine also has an exhaust system that includes an exhaust conduit to carry exhaust gas away from the engine as well as an exhaust gas oxygen ("EGO" or "ego") sensor. The EGO sensor detects the level of oxygen in the exhaust gas and provides a signal to the air-fuel distribution control to increase or decrease the amount of oxygen in the air-fuel mixture being supplied to the engine. The EGO sensor often operates much as a switch, giving a high (or "one") value when the air-fuel ratio is below a predetermined level and a low (or "zero") value when the air-fuel ratio is above the predetermined level.

A feedback mechanism, however, that simply advises the air-fuel distribution control as to whether or not the oxygen concentration in the exhaust gas is above or below a predetermined set point does not allow for optimum performance in every engine, since engines and their operating environments vary. The air-fuel mixture supplied to an engine often needs to be adjusted upward or downward, depending on a variety of different variables.

Prior art references disclose the use of oxygen sensors. For example, U.S. Pat. No. 4,953,351, issued to Motz et al., discloses a combustion control. The Motz et al. patent states that control operation for an engine may be impaired by several factors (such as the aging of the lambda probe). In order to allow for such factors, the set point of the controller is adjusted under certain conditions or at certain intervals. Thus, information as to whether or not the exhaust gas oxygen level concentration is above or below a predetermined set point of a particular oxygen level sensor does not, by itself, necessarily ensure that all engines under all conditions will operate at an optimum air-fuel ratio.

Variations in engine fuel control, variations in engine tolerances, the type of exhaust system used with the engine, the acceleration and deceleration inputs provided to the engine by the driver of the vehicle, the quality of the combustion occurring within the engine, the speed and load experienced by the engine, the altitude of the vehicle above sea level, and the temperature of the vehicle, and as well as other environmental factors and the age of the lambda probe, all influence the air-fuel ratio that is optimum for a particular engine. Unfortunately, many of the presently available air-fuel controls do not allow for a correction of the air-fuel injection system, so as to determine the effect of all the above conditions on the optimum air-fuel ratio.

SUMMARY OF THE INVENTION

The present invention is a method for controlling the air-fuel ratio of the air-fuel mixture provided to an engine. The engine includes a sensor switch, which provides an oxygen level signal, and an air-fuel distribution control, which receives a control signal and responsively provides an air-fuel mixture to the engine. The method comprises the steps of changing the normal air-fuel mixture provided to the engine until the sensor switch changes state. Thereafter, the actual change in the air-fuel ratio that occurred before the sensor switch changed states is detected to determine an actual variance. The actual variance in the air-fuel ratio is compared with a nominal variance to compute a correction factor. The correction factor may then be used to adjust operation of the air-fuel distribution control during normal operation of the engine.

Yet another embodiment of the present invention comprises a control assembly for adjusting the air-fuel ratio. The control assembly includes an oxygen sensor switch for determining the oxygen level and responsively changing states when the oxygen level moves across a predetermined threshold The system further includes a control assembly that senses a change of state of the oxygen sensor switch and provides an air-fuel control signal to the air-fuel distribution control. The control assembly changes the air-fuel mixture signal and detects the amount of change in air-fuel ratio required in order to effect a change in state of the oxygen sensor switch. This actual change in the air-fuel ratio that occurred is an actual variance. The actual variance is then compared with a nominal variance to arrive at a correction factor. The correction factor may then be used to adjust the operation of the air-fuel distribution system during normal operation of the engine.

These and other features of the present invention are discussed or apparent in the following detailed description.

BRIEF DESCRIPTION OF THE DRAWINGS

A preferred embodiment of the present invention is described herein with reference to the drawings wherein:

FIG. 5 is a flow chart showing the decision process used by the microprocessor shown in FIG. 4.

DETAILED DESCRIPTION OF PREFERRED EMBODIMENTS

I. Introduction

Figure 1:
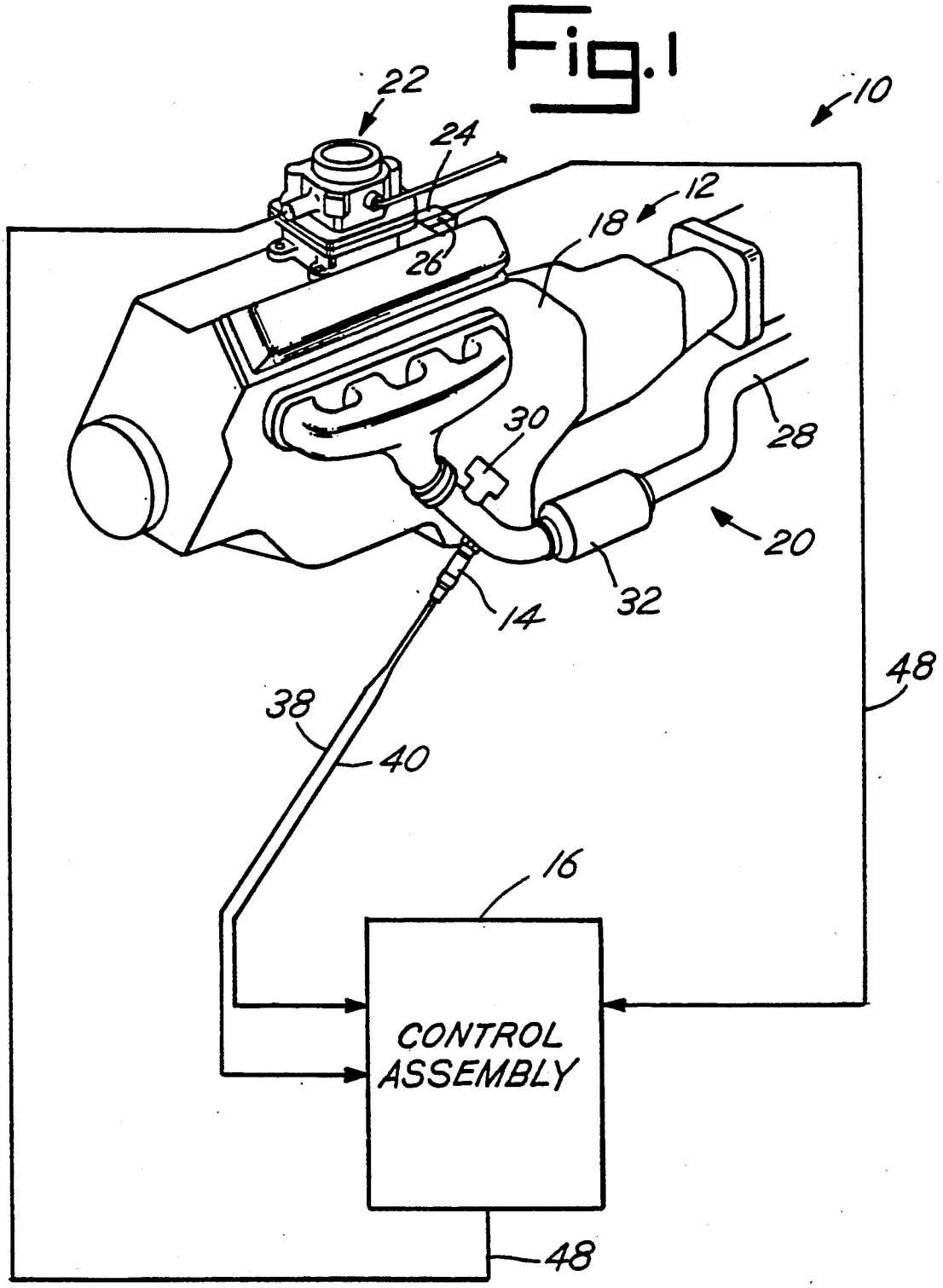
FIG. 1 is a diagram of a preferred embodiment of the present invention.

Referring to FIGS. 1–5, a preferred embodiment of the present invention is shown as an air-fuel control system 10 on an engine 12. The system 10 includes an EGO sensor (or EGO sensor switch) 14 and a control assembly 16. In addition to the system 10, the engine 12 includes a block 18 having movable cylinders (not shown), an exhaust system 20, an air-fuel distribution control 22, and both a speed sensor 24 and a load sensor 26. The exhaust system includes an exhaust conduit or pipe 28, to carry exhaust gas away from the engine block 18, an air blower 30, and a catalytic converter 32.

The EGO sensor 14 (which may include, for example, a heated exhaust gas oxygen sensor) provides an oxygen level signal, or state signal, along first and second leads 38, 40, to the control assembly 16. In the preferred embodiment shown, the EGO sensor 14 is placed upstream of the catalytic converter 32. Alternative embodiments also include, for example, an EGO sensor placed downstream of the catalytic converter 32.

Figure 2:
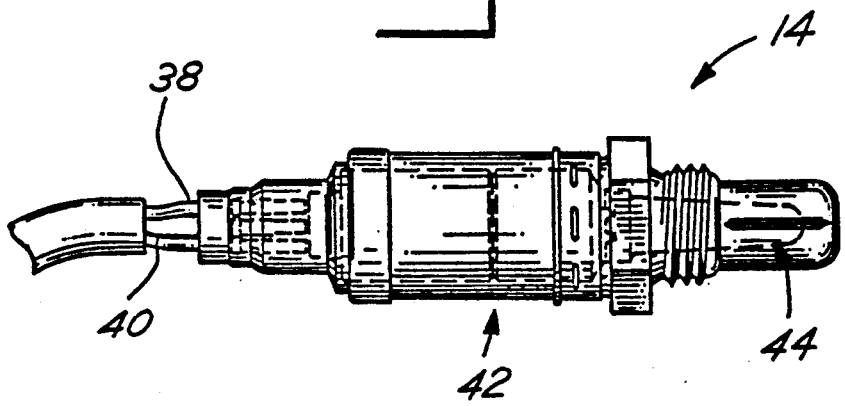
FIG. 2 is a side view of an EGO sensor used in the preferred embodiment shown in FIG. 1.

As shown in FIG. 2, the EGO sensor 14 includes a metal, outer canister 42 and a sensing tip 44. The canister 42 is screwed into the exhaust pipe 28, bringing the tip 44 in contact with the exhaust gas flowing from the engine 12 through the exhaust pipe 28. The tip 44 is comprised of zirconia dioxide and provides a differential voltage along the first and second leads 38, 40 that is indicative of the oxygen concentration adjacent the tip 44.

Figure 3:
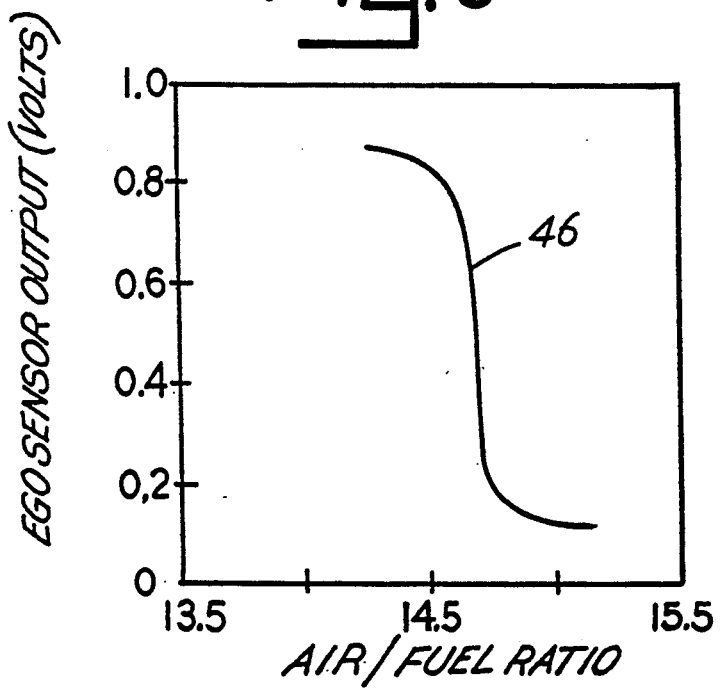
FIG. 3 is a graph showing the output of the EGO sensor shown in FIG. 2, as the air-fuel ratio of the engine shown in FIG. 1 changes.

The differential voltage supplied by the EGO sensor 14 may, for example, exhibit a characteristic such as that shown by the graph in FIG. 3. FIG. 3 shows experimentally derived data 46 for a typical EGO sensor, where there is a varying air-fuel ratio supplied to the engine 12. For an air-fuel ratio supplied to the engine 12 less than, approximately, 14.7, a "high" voltage (over 0.8 volt) is supplied along the leads 38, 40. For an air-fuel ratio in excess of, approximately, 14.7, a "low" voltage (less than 0.2 volt) is supplied.

The speed and load sensors 24, 26 also provide an input along leads 48 to the control assembly 16. In response, the control assembly 16 provides a control signal, via the leads 48, to the air-fuel distribution control 22, which, in turn, responsively provides a mixture of air and fuel to the cylinders within the engine 12.

For purposes of illustration, a general description of the operation of the control assembly 16 is set forth immediately below. A more detailed description then follows.

II. General Description of Operation of the Control Assembly 16

Figure 4:
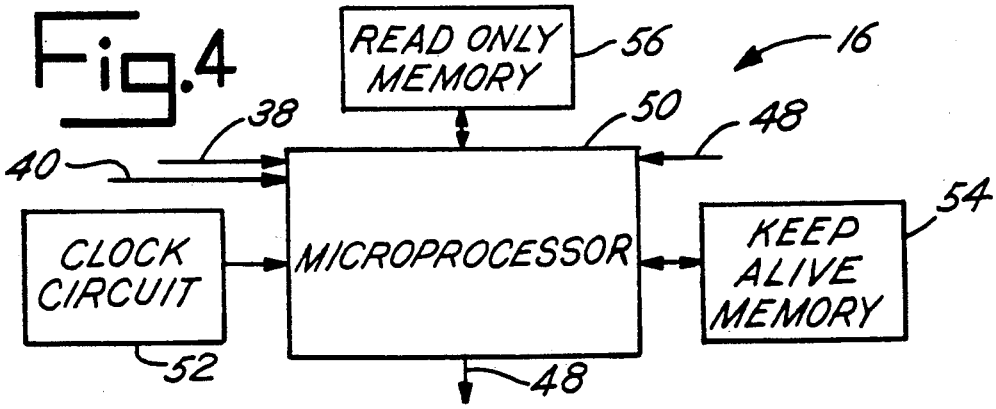
FIG. 4 is a detailed diagram of the control assembly shown in FIG. 1.

A more detailed diagram of the control assembly 16 shown in FIG. 1 is set forth in FIG. 4. The control assembly 16 includes a microprocessor 50 interconnected to a clock circuit 52, a "Keep Alive Memory" (RAM) 54, and a Read Only Memory (ROM) 56. The Read Only Memory includes a stabilized open loop fuel table. This is an eight by ten table of lambda values as a function of engine speed and load.

The engine 12 may operate in a "normal" or "open loop" mode the majority of the time. A normal mode is used here to denote an open loop control system, in which the air-fuel distribution control 22 provides an air-fuel mixture to the cylinders of the engine 12 without direct control by the sensor 14. After a predetermined interval, such as, for example, eight seconds, the clock circuit 52 will advise the microprocessor 50. The microprocessor 50 may then begin to "ramp up" the control signal supplied to the air-fuel distribution control 22 along the leads 48. The air-fuel ratio of the mixture will then steadily increase (or decrease) until the EGO sensor 14 changes state and, for example, instead of providing a high signal, provides a low signal along the leads 38, 40. The microprocessor 50 then keeps track of the amount that the air-fuel mixture has changed from the initial "ramp up" of the control signal to when the EGO sensor 14 changed state. The amount that the air-fuel mixture has changed in order to cause a change of state of the EGO sensor may be referred to as an actual variance.

Upon receiving inputs along the leads 48 regarding the load and speed of the engine 12, the microprocessor 50 inquires, in the Read Only Memory 56, as to an appropriate air-fuel mixture for the particular speed and load experienced by the engine 12. The microprocessor 50 determines the amount of change in the air-fuel mixture that should have occurred before the EGO sensor 14 changed state if the engine 12 was operating substantially as reflected by the values in the Read Only Memory 14. The amount of change in the air-fuel ratio that would be required for a given speed and load of the engine, in order to cause the EGO sensor 14 to change state as reflected by the appropriate value in the ROM 56, is referred to as a nominal variance.

The actual amount that the air-fuel ratio changed (actual variance) is then compared with the calculated amount change of air-fuel ratio that would be required if the engine were operating exactly as contemplated by the values found in the Read Only Memory 56 (nominal variance). This difference between actual and nominal variances is then used to compute a correction factor. The correction factor may then be used, after the engine 12 resumes normal, open loop operation, to adjust any inputs to the air-fuel distribution control 22.

III. Detailed Description of Operation of the Control Assembly 16

A. Overview

The term lambda is used to refer to the air-fuel ratio that will result in the signal from an EGO sensor indicating that the sensor is operating at stoichiometry. In the case of an internal combustion engine using standard, unleaded gasoline, lambda is usually approximately equal to an air-fuel ratio of 14.7.

Thus, as shown in FIG. 3, the set point, or decision point, of the EGO sensor 14 is approximately 14.7. At an air-fuel mixture higher than 14.7, the EGO sensor 14 has "zero" state (which may be indicated, for example, by providing a low voltage). With an air-fuel ratio lower than 14.7, the EGO sensor 14 switches to a "one" (which may be signified, for example, by providing a high voltage).

Lambse is a factor that relates lambda with a preferred air-fuel ratio. The nominal air-fuel ratio for a given speed and load of an engine may be theoretically and/or experimentally derived. The nominal air-fuel ratio may be found in the Read Only Memory 56. Generally, Lambse is a value which is bounded by 0 and 2. For an internal combustion engine using gasoline, $14.7 \times$ lambse approximately equals the nominal air-fuel ratio for the engine, for a given speed and load condition.

Thus, for example, if for a given speed and load condition an engine should have an air-fuel ratio of 13.0, lambse equals 0.88 (since $14.7 \times 0.88 = 13.0$). The nominal variance, or nominal lambse, stored in the Read Only Memory 56 for the given speed and load experienced by the engine would be 0.88.

Assume, however, that, after a predetermined interval, such as 8 seconds, the microprocessor 50 changes the control signal to the air-fuel distribution control 22, such that the air-fuel mixture begins to increase until it reaches 14.7. The EGO sensor 14 then switches states and provides a low voltage to the microprocessor 50 rather than a high voltage. Also assume, however, that the engine under consideration is not operating exactly as predicted, because of variations in tolerances of parts within the engine or other factors. Thus, the engine is not operating exactly as predicted by the lambse value found in the Read Only Memory 56 for the particular speed and load experienced by the engine 12. Assume further that the air-fuel ratio rose by only 1.0, rather than 1.7, before the EGO sensor 14 changed state. This indicates that the engine was actually operating at an air-fuel ratio of 13.7, rather than 13.0, even though an air-fuel ratio of 13.0 may provide more optimum engine performance.

With the present invention, the microprocessor 50 would then compute a correction factor. Lambda multiplied by the actual lambse value, multiplied by the correction factor, will then equal the nominal air-fuel ratio inherent in the Read Only Memory 56.

Thus, in the example described above, the correction factor would equal 0.95, such that:

lambda (14.7) × lambse (.88) × the correction factor (.95) = the nominal air-fuel ratio found in the Read Only Memory (13.0).

The correction factor of 0.95 may then be applied to all other signals supplied to the air-fuel distribution control 22, when the engine 12 resumes operating in an open loop condition. As a result, the engine 12 operate more closely to the optimum air-fuel ratio for the speed and load experienced by that particular engine 12 in that particular environment.

Upon leaving the closed loop operation (where the air-fuel mixture is momentarily ramped upward, the EGO sensor 14 changes state, and the correction factor is calculated), the system 10 may then allow the engine 12 to revert to an open loop system. In open loop operation, the sensor 14 no longer has direct control on the air-fuel ratio of the control 22.

For example, if, after returning to an open loop operation, the air-fuel distribution control 22 described above receives a signal that would otherwise cause it to provide an air-fuel mixture having a ratio of 13.5, the signal will be diminished, or multiplied by the correction factor of 0.95 (for an effective signal corresponding to a ratio of 12.83). This results in a more optimum performance of the engine 12. After predetermined interval (such as eight seconds) the control assembly 16 will again take over command of the control signal for the air-fuel distribution control 22 to again change, or ramp up, the air-fuel ratio until the EGO sensor 14 changes state.

During the time interval when the sensor 14 is not being used for closed loop control of the air-fuel mixture (and the engine 12 is operating in an open loop condition), secondary air injection upstream of the exhaust gas oxygen sensor can be used to reduce engine emissions. The blower 30 may inject air into the exhaust gas, during the interval, to further induce conversion of exhaust gas constituents into less noxious compounds. The blower 30 does not operate during the momentary closed loop intervals, when the correction factor is being determined by the control assembly 16.

In some embodiments of the present invention, the predetermined interval is nominally set at eight seconds. The clock circuit 52 advises the microprocessor 50 when eight seconds has elapsed and the time has arrived to again ramp up the air-fuel ratio of the mixture supplied to the engine 12. In one embodiment, those periods of time in which the engine 12 is operating in a particular condition, such as, for example, deceleration, are not counted as a part of the interval. Thus, for example, if, during the predetermined eight second interval of open loop operation, the engine 12 decelerates for four seconds, the actual interval between closed loop operations would be twelve, rather than eight, seconds.

In another embodiment, the system 10 also keeps the engine 12 in a closed loop operation for a predetermined interval after the predetermined interval of open loop operation. Thus, for example, the control assembly 14 may, upon receiving a signal that the EGO sensor 14 has changed state, allow the air-fuel ratio to decease until the EGO sensor 14 again switches state. Thereafter, the control assembly 14 may then, for example, increase the air-fuel ratio until the EGO sensor 14 again switches state. This process of increasing and decreasing the air-fuel ratio by the control assembly 16 may continue until, for example, the EGO sensor 14 switches state a predetermined number of times, such as, for example, eight. The correction factor used during the next open loop operation is then determined as an average of the correction factors determined during the closed loop operation. In this way, a sporadic or erroneous changes of state by the EGO sensor 14 will not dramatically influence the operation of the engine 12.

Thus, the correction factor is generated at the engine speed and power point that the engine 12 is currently running. The optimum air-fuel ratio for that engine speed and power output can be set and maintained for a calibratable time period. During this period, the fuel correction factor will be applied to the fuel output and the optimum air-fuel ratio will be substantially achieved. At the end of this period, the exhaust gas oxygen sensor 14 will again be put into control of the fuel system, and the air-fuel ratio will be momentarily go to 14.7 to 1. A new fuel correction factor will be established by the process and stored in the keep alive memory 54. The optimum air-fuel ratio with the new fuel correction factor will then be delivered to the engine.

After the predetermined interval has elapsed, however, and a new correction factor is determined, the new correction factor replaces the old correction factor in the Keep Alive Memory 54. For the next open loop interval, the new correction factor is used to calibrate inputs to the air-fuel distribution control 22.

The system 10 thus provides a correction factor to any air-fuel ratio while the engine is operating in that particular region. The fuel correction factor must be updated completely, or within a calibratable time period, in order to exit out of exhaust gas oxygen sensor control. This makes the correction factor applied to the air fuel ratio more accurate. Because the engine air-fuel ratio is sampled, and the correction factors are derived from the sample values, engine component changes (such as, for example, variations in injectors, fuel pressure regulators, and engine components) are accounted for. This accordingly minimizes some emission risks.

B. Flow Chart of Microprocessor Operation

A flow chart showing the general process used by the microprocessor 50 in determining a correction factor is set forth in FIG. 5. As shown in FIG. 5, in step 100, the microprocessor 50 first determines whether the time has arrived for returning to a closed loop operation from the normal open loop operation. If the time is not yet occurred, the microprocessor 50 waits a predetermined interval, at step 102, and then inquires again whether the time has elapsed.

If the time has arrived for closed loop operation, at step 104, the microprocessor 50 changes, or ramps up, the air-fuel ratio. If, at step 106, the microprocessor 50 detects that the EGO sensor 14 has switched states, the microprocessor 50 determines, at step 108, what the new lambse should equal.

If a predetermined number of EGO switches is found to have occurred at step 110, the appropriate nominal lambse is taken from the Read Only Memory 56 at step 112. The nominal lambse is then compared, at step 114, to the new average lambse to compute a new correction factor.

The new correction factor is then inserted into the Keep Alive Memory at step 116. The control assembly 16 allows the engine 12 to return to an open loop operation at step 118. The correction factor may then be used for further inputs to the air-fuel distribution control 22 during the next predetermined interval.

C. Microprocessor Subroutines

1. Generally

The subroutines used by the microprocessor 50, as well as definitions of terms used in the subroutines, are set forth below. The defined terms and variables are expressed in all capital letters.

2. Definitions

BIAS: Air-fuel signal adjustment. A BIAS applied to the ego sensor output will allow to engine 12 to operate in a more rich or more lean condition.

CLOSED-LOOP-FLAG Internal "note" that signifies, when it is a "one value," that the system is operating in a closed loop condition.

CORRECTION-FACTOR: Calculated number that may be used during open loop operation to adjust the signal applied to the air-fuel distribution control 22. Thus, in a internal combustion engine using gasoline, 14.7×LAMBSE×CORRECTION-FACTOR=-NOMINAL-AIR/FUEL-RATIO. Immediately after the engine 12 stops closed loop operation and begins open loop operation, CORRECTIONFACTOR=AVERAGE-LAMBSE.

EGO-CONSTANT: Calibratable number of times that the ego-sensor 14 must change states before the engine 12 resumes open loop operation.

EGO-SWITCH-COUNTER: Incrementing parameter indicating how many times the ego switch 14 has changed states since the system 10 entered the closed loop condition.

LAMBDA: Air-fuel ratio that will result in the signal from an ego sensor 14 indicating that it is operating at stoichiometery. In the case of an internal combustion engine using gasoline, LAMBDA approximately equals 14.7.

LAMBSE: Factor that relates LAMBDA with the nominal air-fuel ratio. Generally, the factor is approximately bounded by 0 and 2. For an internal combustion engine using gasoline, 14.7× LAMBSE approximately equals the preferred air-fuel ratio for the engine at a particular speed and load condition.

AVERAGE-LAMBSE: Average of LAMBSE during prior ego switches (which occurred during the most recent interval of closed loop operation).

DELTA-LAMBSE: Calibratable change in the average LAMBSE value that will allow the system 10 to return to an open loop condition. A typical value is 0.02.

NEW-LAMBSE: The most recent value of LAMBSE, which was required for the ego sensor 14 to switch states.

NOMINAL-LAMBSE: The value of LAMBSE that, according to a table of derived values, LAMBSE should approximately equal for a given speed and load experienced by an engine. For better engine operation, the NOMINAL LAMBSE may be adjusted up or down, for a particular engine and operating environment. See CORRECTION-FACTOR.

LOOK-UP TABLE: Stabilized open loop fuel table; an 8×10 table of nominal lambse values, set forth as a function of engine speed and load, found in the Read Only Memory 56.

OPEN-LOOP-FLAG: Internal "note" that signifies, when it is a "one value," that the system 10 is operating in an open loop condition.

OPEN-LOOP-TIMER: A system timer that indicates how long, in seconds, that the system 10 has been operating in an open loop mode. The timer may exclude, from the timed interval, periods that the engine 12 operates under certain conditions, such as, for example, deceleration.

OPEN-LOOP-TIMER≦TIME-OPEN: Condition that defines when it is acceptable to remain in an open loop condition.

SWITCH-FLAG: Internal "note" that signifies that the ego sensor 14 has changed state.

TIME-OPEN: Calibratable time that the system 10 should be in an open loop condition before returning to a closed loop condition.

3. Subroutines a. Routine for determining whether conditions exist for the system 10 to return to an open loop condition from a closed loop condition.

```
If
        CLOSED-LOOP-FLAG = 1
    and
        EGO-SWITCH-COUNTER ≦ EGO-CONSTANT
    and
        [1 + BIAS − AVERAGE-LAMBSE] ≦ DELTA-LAMBSE
    Then keep CLOSED-LOOP-FLAG = 1
Else,
    set
            OPEN-LOOP-TIMER = 0
        and
            CLOSED-LOOP-FLAG = 0
    and
        increment
            OPEN-LOOP-TIMER
Else,
        Freeze OPEN-LOOP-TIMER
```

-continued b. Subroutine to increment EGO-SWITCH-COUNTER when the ego sensor 14 switches during closed loop operation.

If

CLOSED-LOOP-FLAG = 1 and

SWITCH-FLAG = 1 then increment EGO-SWITCH-COUNTER else

CLOSED-LOOP-FLAG = 0 and

EGO-SWITCH-COUNTER = 0 c. Subroutine to calculate the correction-factor.

If

[1 + BIAS − AVERAGE-LAMBSE] > DELTA-LAMBSE then recompute AVERAGE-LAMBSE using NEW-LAMBSE until [1 + BIAS − AVERAGE-LAMBSE] ≦ DELTA-LAMBSE.

A preferred embodiment of the present invention has been described herein. It is to be understood, however, that changes and modifications may be made in the embodiments without departing from the true scope and spirit of the present invention, as defined by the appended claims.

I claim:

1. A method for dynamically adjusting an air-fuel mixture supplied to an engine, said mixture defining a ratio between air and fuel, said engine exhibiting operating parameters and including both an exhaust conduit, for carrying exhaust gas from said engine, an oxygen sensor switch, for changing states when an oxygen level in said exhaust conduit moves across a predetermined threshold, and an air-fuel distribution control, for receiving a control signal and responsively providing said mixture to said engine, said engine defining a normal operating condition, when said air-fuel ratio remains substantially directly unaltered by said state of said oxygen sensor switch, said air-fuel ratio defining a first level when said engine is in said normal condition and a second level when said sensor switch changes states, comprising the steps of:

maintaining said engine in said normal operating condition;

detecting said operating parameters of said engine,;

moving said engine from said normal operating condition by changing said air-fuel ratio of said mixture supplied to said engine until said sensor switch changes state;

detecting an actual variance corresponding to a change in said air-fuel ratio that occurred for said engine when said air-fuel ratio moved from said first level to said second level;

determining a nominal variance corresponding to a change in said air-fuel ratio that would have occurred for an exemplary engine under said operating parameters when said air-fuel ratio moved from said first level to said second level;

comparing said actual variance with said nominal variance to determine a correction factor for said control signal; and returning said engine to said normal operating condition and changing said control signal with said correction factor, whereby operation of said air-fuel distribution control is adjusted.

2. A method as claimed in claim 1:

wherein said engine further includes parameter sensors for detecting said engine operating parameters and memory means for storing data corresponding to nominal variances, said nominal variances corresponding to changes in said air-fuel ratio for an exemplary engine under a plurality of operating parameters;

wherein said step of detecting said operating parameters includes the step of monitoring said parameter sensors; and wherein said nominal variance is determined by retrieving from said memory means a nominal variance for said exemplary engine corresponding to said engine parameters detected by said sensors.

3. A method as claimed in claim 2:

wherein said engine operating parameters comprise engine speed and engine load.

4. A method for dynamically adjusting an air-fuel mixture supplied to an engine, said mixture defining a ratio between air and fuel, said engine exhibiting operating parameters and including an exhaust conduit, for carrying exhaust gas from said engine, an oxygen sensor switch, for changing states when an oxygen level in said exhaust conduit moves across a predetermined threshold, and an air-fuel distribution control, for receiving a control signal and responsively providing said mixture to said engine, said engine defining a normal operating condition, when said air-fuel ratio remains substantially directly unaltered by said state of said oxygen sensor switch, said air-fuel ratio defining a first level when said engine is in said normal condition and a second level when said sensor switch changes states, comprising the steps of:

conducting a first test sequence;

waiting a predetermined interval; and conducting a second test sequence, each of said test sequences comprising the steps of:

detecting said operating parameters of said engine;

moving said engine from said normal operating condition by changing said air-fuel ratio of said mixture supplied to said engine until said sensor switch changes state, detecting an actual variance corresponding to a change in said air-fuel ratio that occurred for said engine when said air-fuel ratio moved from said first level to said second level, determining a nominal variance corresponding to a change in said air-fuel ratio that would have occurred for an exemplary engine under said operating parameters when said air-fuel ratio moved from said first level to said second level;

comparing said actual variance with said nominal variance to determine a correction factor for said control signal, and returning said engine to said normal operating condition and changing said control signal with said correction factor, whereby operation of said air-fuel distribution control is adjusted.

5. A method as claimed in claim 4 wherein said predetermined interval is extended when said engine is in a state of deceleration.

6. A method as claimed in claim 4 wherein said step of changing said air-fuel ratio of said mixture provided to said engine comprises the steps of changing said air-fuel ratio of said mixture supplied to said engine until said sensor switch changes state a predetermined number of times, whereby said correlation factor is less influenced by sporadic changes of state by said sensor switch.

7. A system for dynamically adjusting an air-fuel mixture supplied to an engine, said mixture defining a ratio between air and fuel, and said engine exhibiting operating parameters and including an exhaust conduit for carrying exhaust gas from said engine, comprising, in combination:

an air-fuel distribution control for receiving a control signal and responsively providing said mixture to said engine;

an oxygen sensor for determining an oxygen level in said exhaust conduit and responsively providing an oxygen level signal, said engine defining a normal operating condition when said air-fuel ratio remains substantially directly unaltered by said oxygen level signal, said oxygen sensor changing said oxygen level signal when said oxygen level moves across a predetermined threshold, and said air-fuel ratio defining a first level when said engine is in said normal condition and a second level when said oxygen level signal changes;

control assembly means for receiving said oxygen level signal and providing said control signal to said air-fuel distribution control, said control assembly means following the steps of:

conducting a first test sequence, waiting a predetermined interval, and conducting a second test sequence, each of said test sequences comprising:

detecting said operating parameters of said engine, moving said engine from said normal operating condition by changing said air-fuel ratio of said mixture supplied to said engine until said oxygen level signal changes, detecting an actual variance corresponding to a change in said air-fuel ratio that occurred for said engine when said air-fuel ratio moved from said first level to said second level, determining a nominal variance corresponding to a change in said air-fuel ratio that would have occurred for an exemplary engine under said operating parameters when said air-fuel ratio moved from said first level to said second level, comparing said actual variance with said nominal variance to determine a correction factor for said control signal, and returning said engine to said normal operating condition and changing said control signal with said correction factor, whereby operation of said air-fuel distribution control is adjusted.

8. A system as claimed in claim 7 further comprising parameter sensors and a read only memory, said sensors detecting said engine operating parameters and advising said control assembly means of said parameters, and said read only memory containing a listing of nominal variances corresponding to changes in said air-fuel ratio for an exemplary engine under a plurality of engine parameters, said control assembly means monitoring said oxygen sensor and responsively determining said nominal variance by retrieving from said read only memory a nominal variance for said exemplary engine corresponding to said operating parameters detected by said sensors.

9. A system as claimed in claim 8 wherein said parameter sensors comprise sensors for detecting both a speed and load experienced by said engine.

10. A system as claimed in claim 9 further comprising timer means for waiting a predetermined interval, while said engine is in a normal operating condition, and then enabling said control assembly to provide a signal to said air-fuel distribution control to initiate said second test sequence.

11. A system as claimed in claim 10 wherein said timer means extends said predetermined interval when said engine is in a state of deceleration.

12. A system as claimed in claim 11 wherein said control assembly means continues to provide a single to said air-fuel distribution control to change to said air-fuel ratio until said sensor switch changes state a predetermined number of times, whereby said correction factor is less influenced by sporadic changes of said oxygen level signal.

* * * * *